US008577747B1

(12) United States Patent
Krechel et al.

(10) Patent No.: US 8,577,747 B1
(45) Date of Patent: Nov. 5, 2013

(54) METHODS AND SYSTEMS FOR ACQUIRING PARTS FROM ONE OR MORE SUPPLIERS

(75) Inventors: William E. Krechel, Thompsons Station, TN (US); Kenneth G. Owens, Olivette, MO (US); Alexandra Brintrup, London (GB); Tomas Sanchez-Lopez, Cardiff (GB); Duncan McFarlane, Cambridge (GB); Mark G. Harrison, Cambridge (GB)

(73) Assignee: The Boeing Company, Chicago, IL (US)

( * ) Notice: Subject to any disclaimer, the term of this patent is extended or adjusted under 35 U.S.C. 154(b) by 192 days.

(21) Appl. No.: 13/184,550

(22) Filed: Jul. 17, 2011

(51) Int. Cl.
*G06Q 30/00* (2012.01)

(52) U.S. Cl.
USPC ..... 705/26.3; 705/26.1; 705/26.4; 705/26.7; 705/26.81; 700/28; 700/52; 700/53; 700/49; 700/67

(58) Field of Classification Search
USPC ..... 705/26.1, 26.3, 26.4, 26.7, 26.81; 700/28, 52, 53, 49, 67
See application file for complete search history.

(56) References Cited

U.S. PATENT DOCUMENTS 5,842,178 A * 11/1998 Giovannoli ..... 705/26.4
2002/0107821 A1* 8/2002 Karas ..... 706/12

OTHER PUBLICATIONS

Brintrup, Alexandra, et al., Will Intelligent Assets Take Off? Towards Self-Serving Aircrafts, 13 pages, May-Jun. 2011.
Wikipedia Contributors, Double Auction, Aug. 31, 2010, 2 pages, Page Version ID: 382058572, Wikipedia, The Free Encyclopedia.
Kruse, Sebastian, et al., Self-serving assets are competing! A multi-agent system for handling competition among products, Apr. 2010, 17 pages, Vol. ?, No. ?, IEEE Transactions on Computational Intelligence and AI in Games.

* cited by examiner

*Primary Examiner* — Yogesh C Garg
(74) *Attorney, Agent, or Firm* — Armstrong Teasdale LLP

(57) ABSTRACT

Methods and systems for use in acquiring parts from suppliers using auction information including a requested part and decision criteria from an ordering manager agent and from supplier agents associated with part suppliers. A criteria comparison matrix representing a relative importance of each decision criterion is created. A criteria importance vector is created based on the criteria comparison matrix, and a supplier comparison matrix corresponding to each decision criterion is also created. The supplier comparison matrix represents a relative ranking of each supplier with respect to the corresponding decision criterion. A supplier criteria ranking vector corresponding to each decision criterion is created based on the supplier comparison matrix that corresponds to the decision criterion. The supplier criteria ranking vectors and the criteria importance vector are combined to create a supplier score matrix associated with the ordering manager agent and indicating a score associated with each supplier.

14 Claims, 4 Drawing Sheets

METHODS AND SYSTEMS FOR ACQUIRING PARTS FROM ONE OR MORE SUPPLIERS

BACKGROUND

The field of the disclosure relates generally to part acquisition and, more specifically, to methods and systems for use in acquiring parts from one or more suppliers.

At least some known methods of purchasing goods implement a double auction process that assumes perfectly substitutable goods. Under such an assumption, buyers and sellers have no preference regarding who they trade with on the opposing side of the market. However, in a typical service supply chain, the price is not the only attribute that determines the value of a deal to a buyer or seller, and other criteria need to be taken into account when determining the utility of a certain match due to the imperfectly substitutable nature of goods, buyers, and/or sellers in a typical supply chain context.

BRIEF DESCRIPTION

In one aspect, a method for use in acquiring parts from one or more suppliers is provided. The method includes receiving, by an auctioneer agent executed by a computing system, auction information including a requested part and a plurality of decision criteria from an ordering manager agent and from a plurality of supplier agents associated with a plurality of suppliers of the requested part. The auctioneer agent creates a criteria comparison matrix representing a relative importance of each decision criterion. The auctioneer agent also creates a criteria importance vector based on the criteria comparison matrix and creates a supplier comparison matrix corresponding to each decision criterion. The supplier comparison matrix represents a relative ranking of each supplier of the plurality of suppliers with respect to the corresponding decision criterion. The auctioneer agent further creates a supplier criteria ranking vector corresponding to each decision criterion based on the supplier comparison matrix that corresponds to the decision criterion. The auctioneer agent combines the supplier criteria ranking vectors and the criteria importance vector to create a supplier score matrix associated with the ordering manager agent. The supplier score matrix indicates a score associated with each supplier, and the requested part is ordered from one or more suppliers based on the supplier score matrix.

In another aspect, a system for use in managing part replacement associated with a manufactured product is provided. The system includes a storage device and a processor unit coupled in communication with the storage device. The storage device is configured to store auction information including a requested part and a plurality of decision criteria from an ordering manager agent and from a plurality of supplier agents associated with a plurality of suppliers of the requested part. The processor unit is programmed to create a criteria comparison matrix representing a relative importance of each decision criterion and to create a criteria importance vector based on the criteria comparison matrix. The processor unit is also programmed to create a supplier comparison matrix corresponding to each decision criterion. The supplier comparison matrix represents a relative ranking of each supplier of the plurality of suppliers with respect to the corresponding decision criterion. The processor unit is further programmed to create a supplier criteria ranking vector corresponding to each decision criterion based on the supplier comparison matrix that corresponds to the decision criterion, and to combine the supplier criteria ranking vectors and the criteria importance vector to create a supplier score matrix associated with the ordering manager agent. The supplier score matrix indicates a score associated with each supplier, and the requested part is ordered from one or more suppliers based on the supplier score matrix.

In yet another aspect, one or more non-transitory computer-readable media having computer-executable components embodied thereon are provided. The computer-executable components include a supplier agent and an auctioneer agent. When executed by at least one processor unit, the supplier agent causes the processor unit to request an auction based on a shortage of a requested part. When executed by at least one processor unit, the auctioneer agent causes the processor unit to receive, based on the request for an auction, auction information including the requested part and a plurality of decision criteria from an ordering manager agent and from a plurality of supplier agents associated with a plurality of suppliers of the requested part. The auctioneer agent further causes the processor unit to create a criteria importance vector based on a criteria comparison matrix representing a relative importance of each decision criterion, and to create a supplier comparison matrix corresponding to each decision criterion. The supplier comparison matrix represents a relative ranking of each supplier of the plurality of suppliers with respect to the corresponding decision criterion. The auctioneer agent further causes the processor unit to create a supplier criteria ranking vector corresponding to each decision criterion based on the supplier comparison matrix that corresponds to the decision criterion, and to combine the supplier criteria ranking vectors and the criteria importance vector to create a supplier score matrix associated with the ordering manager agent. The supplier score matrix indicates a score associated with each supplier, and the requested part is ordered from one or more suppliers based on the supplier score matrix.

The features, functions, and advantages that have been discussed can be achieved independently in various embodiments or may be combined in yet other embodiments further details of which can be seen with reference to the following description and drawings.

DETAILED DESCRIPTION

Embodiments described herein improve sourcing decisions, enabling the acquisition of goods, such as physical parts to be installed in a manufactured product (e.g., a vehicle), to be faster and more traceable than with conventional sourcing methods. Exemplary embodiments use an automated buyer-supplier matching platform named Self-Aware Assets in a Highly Networked Environment (SAHNE) that utilizes an automated double-auction mechanism.

The SAHNE platform is based on software agent technology, in which a physical part is represented by a part agent making sourcing decisions on behalf of the part. When a part agent determines that replacement and/or service of a corresponding physical part is desired, the part agent contacts an ordering manager agent that is associated with the part agent and/or with the part.

Such ordering manager agents manage the ordering process, searching for part providers ("suppliers") through electronic directories ("yellow pages") and negotiate with suppliers through supplier agents that represent the suppliers. Ordering manager agents may be organized by part type. Further, ordering manager agents may form societies with other ordering manager agents for ease of messaging when changes occur that concern all managers associated with the manufactured product. In addition, ordering manager agents may form societies with their associated part agents. These societies facilitate the exchange (e.g., broadcast) of messages within the society.

In exemplary embodiments, SAHNE includes an Analytical Hierarchy Process (AHP) that makes sourcing decisions based on bidding prices (e.g., from a buyer), asking prices (e.g., from sellers), and decision criteria other than price, which may be specified by a buyer and/or the suppliers. Such non-price criteria may include, without limitation, an order lead time associated with a supplier, a quality rating associated with a supplier and/or buyer, the physical proximity of parts to the location of the manufactured product, and/or the legal status of a supplier (e.g., whether the supplier is a minority-owned company or a small-to-medium enterprise). Accordingly, sourcing decisions and pricing may reflect factors other than price that are significant to buyers and/or sellers.

Figure 1:
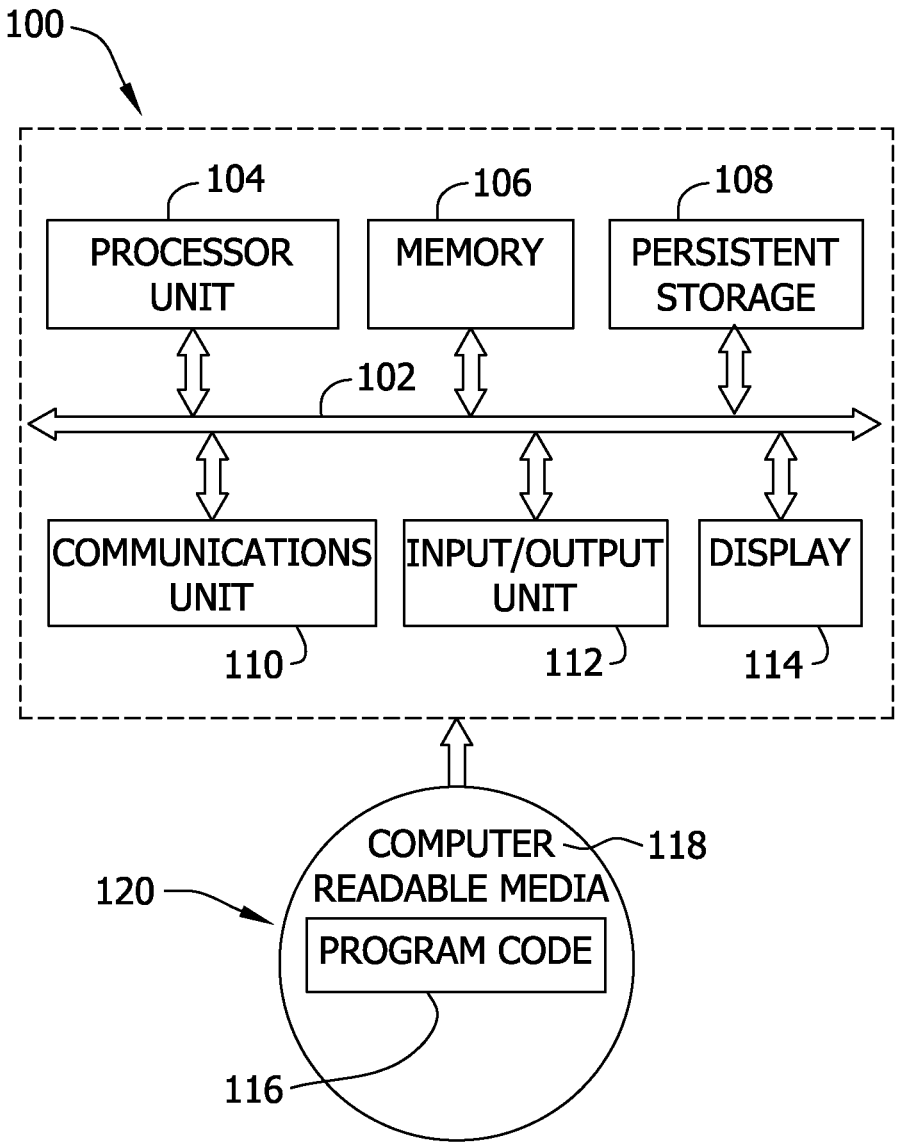
FIG. 1 is a block diagram of an exemplary computing device.

FIG. 1 is a block diagram of an exemplary computing device 100. In the exemplary embodiment, computing device 100 includes communications fabric 102 that provides communications between a processor unit 104, a memory 106, persistent storage 108, a communications unit 110, an input/output (I/O) unit 112, and a presentation interface, such as a display 114. In addition to, or in alternative to, the presentation interface may include an audio device (not shown) and/or any device capable of conveying information to a user.

Processor unit 104 executes instructions for software that may be loaded into memory 106. Processor unit 104 may be a set of one or more processors or may include multiple processor cores, depending on the particular implementation. Further, processor unit 104 may be implemented using one or more heterogeneous processor systems in which a main processor is present with secondary processors on a single chip. In another embodiment, processor unit 104 may be a homogeneous processor system containing multiple processors of the same type.

Memory 106 and persistent storage 108 are examples of storage devices. As used herein, a storage device is any piece of hardware that is capable of storing information either on a temporary basis and/or a permanent basis. Memory 106 may be, for example, without limitation, a random access memory and/or any other suitable volatile or non-volatile storage device. Persistent storage 108 may take various forms depending on the particular implementation, and persistent storage 108 may contain one or more components or devices. For example, persistent storage 108 may be a hard drive, a flash memory, a rewritable optical disk, a rewritable magnetic tape, and/or some combination of the above. The media used by persistent storage 108 also may be removable. For example, without limitation, a removable hard drive may be used for persistent storage 108.

A storage device, such as memory 106 and/or persistent storage 108, may be configured to store data for use with the processes described herein. For example, a storage device may store computer-executable instructions, executable software components (e.g., part agents, ordering manager agents, auctioneer agents, and/or supplier agents), product configurations, available parts, decision criteria, and/or any other information suitable for use with the methods described herein.

Communications unit 110, in these examples, provides for communications with other computing devices or systems. In the exemplary embodiment, communications unit 110 is a network interface card. Communications unit 110 may provide communications through the use of either or both physical and wireless communication links.

Input/output unit 112 enables input and output of data with other devices that may be connected to computing device 100. For example, without limitation, input/output unit 112 may provide a connection for user input through a user input device, such as a keyboard and/or a mouse. Further, input/output unit 112 may send output to a printer. Display 114 provides a mechanism to display information to a user. For example, a presentation interface such as display 114 may display a graphical user interface, such as those described herein.

Instructions for the operating system and applications or programs are located on persistent storage 108. These instructions may be loaded into memory 106 for execution by processor unit 104. The processes of the different embodiments may be performed by processor unit 104 using computer implemented instructions and/or computer-executable instructions, which may be located in a memory, such as memory 106. These instructions are referred to herein as program code (e.g., object code and/or source code) that may be read and executed by a processor in processor unit 104. The program code in the different embodiments may be embodied on different physical or tangible computer-readable media, such as memory 106 or persistent storage 108.

Program code 116 is located in a functional form on non-transitory computer-readable media 118 that is selectively removable and may be loaded onto or transferred to computing device 100 for execution by processor unit 104. Program code 116 and computer-readable media 118 form computer program product 120 in these examples. In one example, computer-readable media 118 may be in a tangible form, such as, for example, an optical or magnetic disc that is inserted or placed into a drive or other device that is part of persistent storage 108 for transfer onto a storage device, such as a hard drive that is part of persistent storage 108. In a tangible form, computer-readable media 118 also may take the form of a persistent storage, such as a hard drive, a thumb drive, or a flash memory that is connected to computing device 100. The tangible form of computer-readable media 118 is also referred to as computer recordable storage media. In some instances, computer-readable media 118 may not be removable.

Alternatively, program code 116 may be transferred to computing device 100 from computer-readable media 118 through a communications link to communications unit 110 and/or through a connection to input/output unit 112. The communications link and/or the connection may be physical or wireless in the illustrative examples. The computer-readable media also may take the form of non-tangible media, such as communications links or wireless transmissions containing the program code.

In some illustrative embodiments, program code 116 may be downloaded over a network to persistent storage 108 from another computing device or computer system for use within computing device 100. For instance, program code stored in a computer-readable storage medium in a server computing device may be downloaded over a network from the server to computing device 100. The computing device providing program code 116 may be a server computer, a workstation, a client computer, or some other device capable of storing and transmitting program code 116.

Program code 116 may be organized into computer-executable components that are functionally related. For example, program code 116 may include one or more part agents, ordering manager agents, auctioneer agents, supplier agents, threads, databases, and/or any component suitable for practicing the methods described herein. Each component may include computer-executable instructions that, when executed by processor unit 104, cause processor unit 104 to perform one or more of the operations described herein.

The different components illustrated herein for computing device 100 are not meant to provide architectural limitations to the manner in which different embodiments may be implemented. The different illustrative embodiments may be implemented in a computer system including components in addition to or in place of those illustrated for computing device 100. For example, other components shown in FIG. 1 can be varied from the illustrative examples shown.

As one example, a storage device in computing device 100 is any hardware apparatus that may store data. Memory 106, persistent storage 108 and computer-readable media 118 are examples of storage devices in a tangible form.

In another example, a bus system may be used to implement communications fabric 102 and may include one or more buses, such as a system bus or an input/output bus. Of course, the bus system may be implemented using any suitable type of architecture that provides for a transfer of data between different components or devices attached to the bus system. Additionally, a communications unit may include one or more devices used to transmit and receive data, such as a modem or a network adapter. Further, a memory may be, for example, without limitation, memory 106 or a cache such as that found in an interface and memory controller hub that may be present in communications fabric 102.

Figure 2:
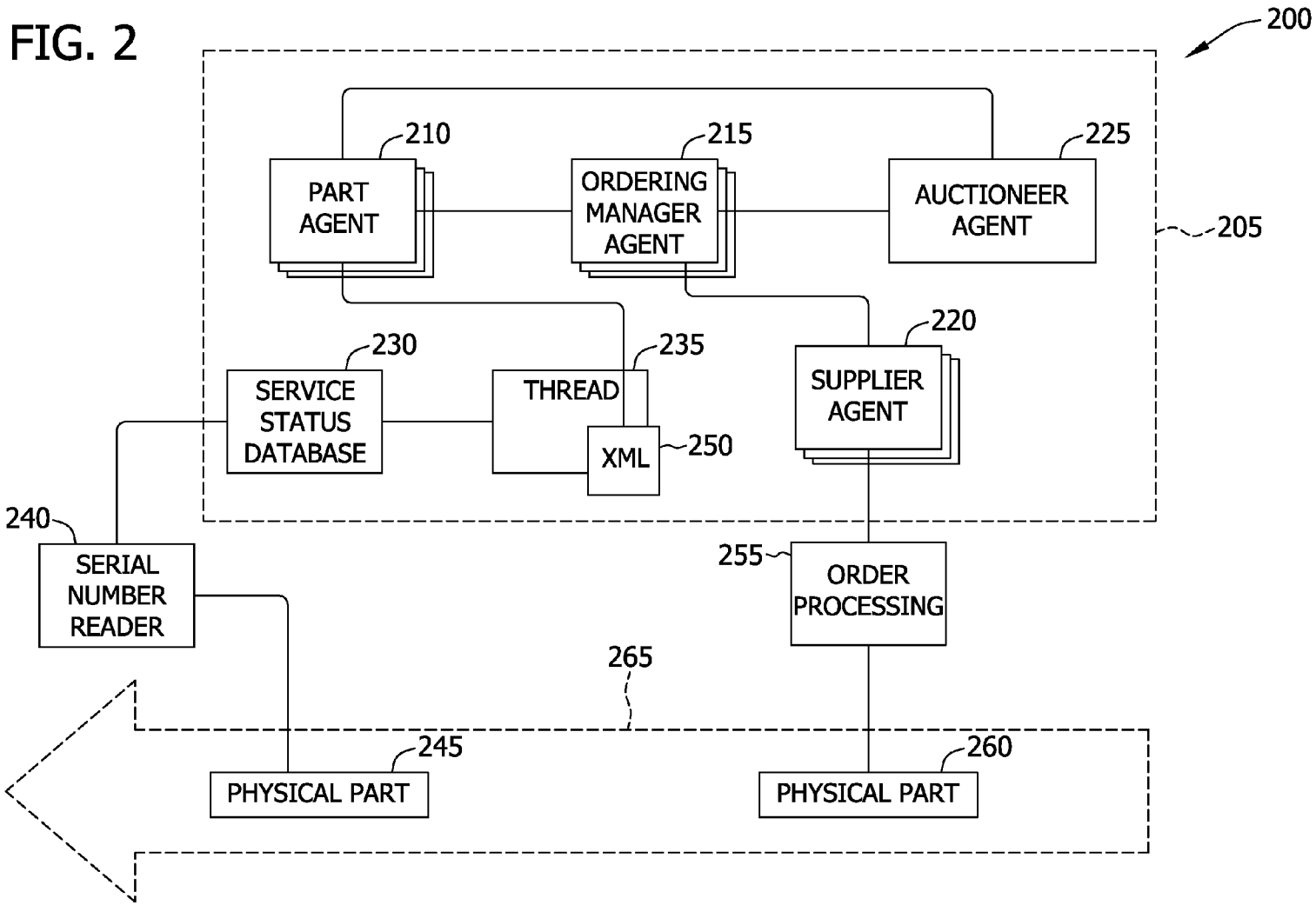
FIG. 2 is a block diagram illustrating an exemplary computing system for use in acquiring parts from one or more suppliers.

FIG. 2 is a block diagram illustrating an exemplary computing system 200 for use in acquiring parts from one or more suppliers. System 200 includes a software system 205 that is executed by one or more computing devices 100 (shown in FIG. 1). Software system 205 includes part agents 210, ordering manager agents 215, supplier agents 220, an auctioneer agent 225, a service status database 230, and a thread 235 for creating part agents 210. Ordering manager agents 215 may represent an entity that desires to acquire one or more parts from suppliers represented by supplier agents 220. This entity may be referred to as a buyer. Suppliers may also be referred to as sellers.

In exemplary embodiments, part agents 210 represent physical parts installed in a manufactured product. Part information associated with a part agent 210 may be created automatically by software system 205. In some embodiments, a serial number reader 240 at a service location is used to scan a physical part 245 and determine a unique identifier (ID) associated with physical part 245. Serial number reader 240 submits the unique ID to service status database 230, which identifies physical part 245 as a new part. Thread 235 detects the new unique ID in service status database 230 and generates a description of the expected attributes and description of a part agent 210 associated with physical part 245. The description may be generated as an Extensible Markup Language (XML) file 250, for example.

A part agent 210 is created by thread 235 to represent physical part 245 and associated with XML file 250, such that the configuration (e.g., expected attributes and behavior) of part agent 210 is accessible to part agent 210. Part agent 210 may store the configuration (e.g., in a database, not shown), creating a persistent record of the configuration status. Any quantity of physical parts 245 may be detected, represented by a part agent 210, and stored in auctioneer agent 225, as described above.

In exemplary embodiments, part agent 210 determines that a replacement of a corresponding physical part 245 by part agent 210 is desired. For example, part agent 210 may determine that replacement is desired based at least in part on a configuration change affecting current part 245, a failure of current part 245, a predicted life of current part 245, an expiry associated with current part 245, an explicit replacement request, and/or any other occurrence that may indicate replacement of current part 245 is desired and/or appropriate.

Part agent 210 provides a replacement notification to an ordering manager agent 215 that is associated with part agent 210 and/or with current part 245. The replacement notification indicates that a replacement of current part 245 is desired. Ordering manager agent 215 may determine whether a configuration change is associated with current part 245, such that the replacement for current part 245 is a new part rather than a direct replacement of current part 245. Regardless of whether the replacement is a direct replacement of current part 245 or a new part, part agent 210 submits an order for one or more of the replacement part to ordering manager agent 215.

Based on the submitted order from part agent 210, ordering manager agent 215 determines what suppliers are capable of providing the requested part and, in appropriate circumstances, works with auctioneer agent 225 to determine an allocation of orders to one or more of the suppliers, as described below with reference to FIGS. 3 and 4. Ordering manager agent 215 transmits an order to one or more supplier agents 220 that represent the suppliers. Each supplier agent 220, in turn, transmits the order to an external order processing system 255 associated with the supplier represented by supplier agent 220. External order processing systems 255 manage the delivery of replacement parts 260 to the location of current part 245 through a distribution channel 265, such as by shipping replacement part 260 by truck or air.

In some embodiment, a supplier agent 220 receives orders from any quantity of part agents 210, as described above. Further, supplier agent 220 may "batch" orders, such as by delaying the fulfillment (e.g., shipping) of orders for a predetermined period of time after receiving an order. Such batching may enable supplier agent 220 to identify a part shortage condition in which the available quantity of an ordered part is less than a total requested quantity.

Figure 3:
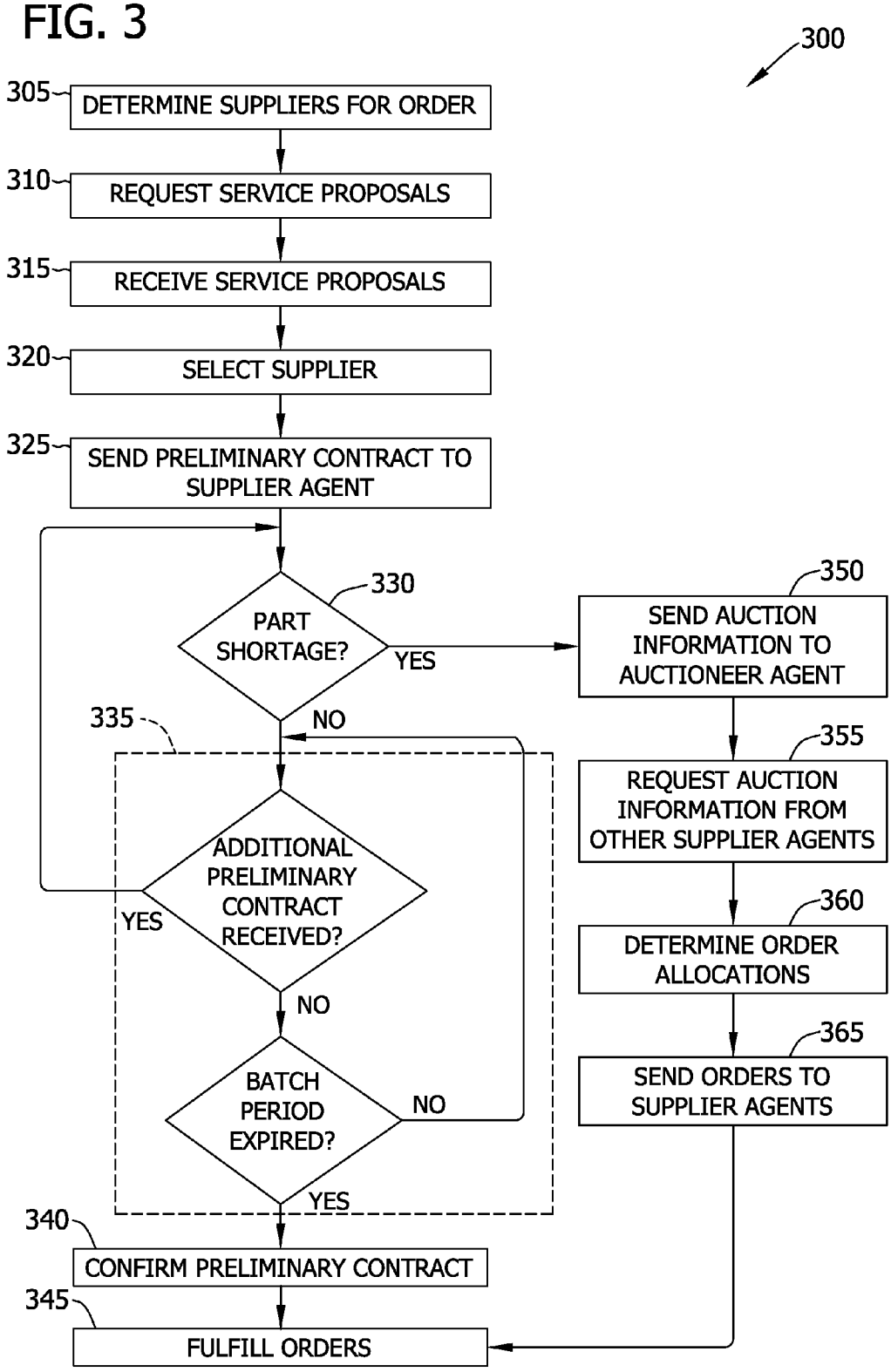
FIG. 3 is a flowchart of an exemplary method that may be performed using the system shown in FIG. 2.

FIG. 3 is a flowchart of an exemplary method 300 that may be performed using system 200. Referring to FIGS. 2 and 3, in exemplary embodiments, in response to receiving an order from a part agent 210, ordering manager agent 215 determines 305 one or more suppliers that are eligible to fulfill the order. For example, ordering manager agent 215 may query a directory, or "yellow pages," that associates each part with one or more suppliers that are capable of providing the part.

Ordering manager agent requests 310 a service proposal from the supplier agent 220 associated with each eligible supplier. Each supplier agent 220 that receives a service proposal request provides a service proposal to ordering manager agent 215. Ordering manager agent 215 receives 315 service proposals from each of the supplier agents 220. The service proposals may include, for example, an asking price representing a price at which a supplier offers to sell the part.

Ordering manager agent 215 selects 320 a supplier based on the service proposals (e.g., by selecting the supplier that provided the lowest asking price) and sends 325 a preliminary purchase contract to the supplier agent 220 that represents the selected supplier. Supplier agent 220 compares the desired quantity of the part to an available quantity of the part to determine 330 whether a shortage of the part exists. If no shortage exists, supplier agent 220 determines 335 whether additional preliminary contracts for the part are received during a predetermined period of time, which may be referred to as a batch time. If no other received preliminary contracts produce a part shortage within the batch time, supplier agent 220 confirms 340 the preliminary contract(s) and fulfills 345 the order.

If a part shortage is determined 330 to exist, supplier agent 220 sends 350 auction information to auctioneer agent 225 based on the determined shortage. The auction information provided by supplier agent 220 may be a portion of the auction information used by auctioneer agent 225 to determine pricing and/or allocation of orders. Such auction information may include, without limitation, the total quantity of requested parts and decision criteria, such as a bidding price associated with the supplier represented by supplier agent 220, an order lead time indicating an expected time required for the supplier to deliver the part(s), a quality rating associated with the supplier (e.g., representing the supplier's rating of the buyer), the physical proximity of parts provided by the supplier to the destination facility of the buyer (e.g., the location of current part 245), the legal status of the supplier (e.g., whether the supplier is a minority-owned company or a small-to-medium enterprise), and/or any other information that may be relevant to auctioneer agent 225 in supplier selection.

Auctioneer agent 225 requests 355 such auction information from the ordering manager agent 215 that sent 325 the preliminary contract to supplier agent 220 and, optionally, to other ordering manager agents 215 in system 205. The ordering manager agents 215 respond with their auction information. This auction information may include, for example, the auction information described above and/or other decision criteria to which supplier agent 220 does not have access, such as a reliability rating and/or other quality rating of the supplier according to the ordering manager agent 215, the contractual priority associated with the supplier, and/or an ease of location associated with the supplier. Accordingly, auctioneer agent 225 receives auction information including the requested part and a plurality of decision criteria from one or more ordering manager agents 215 and from a plurality of supplier agents 220 associated with a plurality of suppliers of the requested part.

In exemplary embodiments, auctioneer agent 225 determines 360 order allocations according to an exhaustive search of AHP scores given to each ordering manager agent 215 and supplier by different allocations, as described below with reference to FIG. 4. The order allocations indicate suppliers selected by auctioneer agent 225 to fulfill orders for the requested part.

Auctioneer agent 225 notifies the ordering manager agents 215 and/or each supplier agent 220 associated with a selected supplier and/or of the order allocation when the allocation process is complete. In exemplary embodiments, auctioneer agent sends 365 an order to each selected supplier agent 220, and each supplier agent fulfills 345 the order, as described above.

Figure 4:
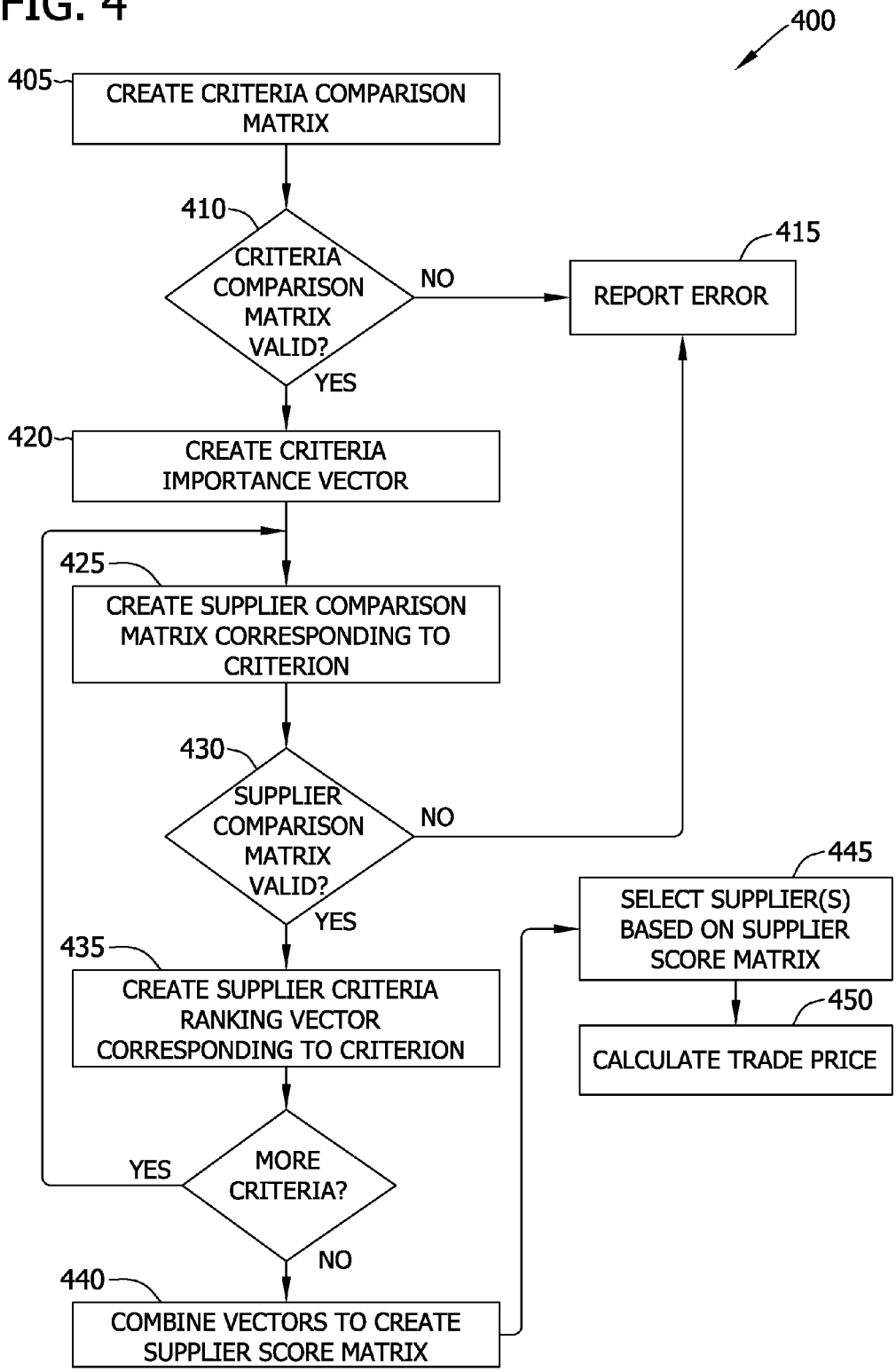
FIG. 4 is a flowchart of an exemplary method for determining order allocations.

FIG. 4 is a flowchart of an exemplary method 400 for determining 360 order allocations (shown in FIG. 3). In exemplary embodiments, method 400 represents an Analytical Hierarchy Process (AHP) performed by auctioneer agent 225 (shown in FIG. 2).

Referring to FIGS. 2 and 4, in exemplary embodiments, auctioneer agent 225 creates 405 a pair wise criteria comparison matrix representing a relative importance of each decision criterion received by auctioneer agent from ordering manager agents 215 and/or supplier agents 220. For example, the importance associated with each decision criterion may be included in the auction information received by auctioneer agent 225. In the criteria comparison matrix, the importance of each criterion C is weighted against other criteria with a value between a minimum value (e.g., ⅙) and a maximum value (e.g., 9), where a value of 1 indicates equal importance, and the maximum value indicates the greatest possible importance of C over the other criterion. Given a matrix M, each entry $M_{ij}$ represents the importance of Criterion $C_i$ to Criterion $C_j$. Note that if $M_{ij}$=x, $M_{ji}$, should equal 1/x.

In some embodiments, auctioneer agent 225 validates 410 the criteria comparison matrix at least in part by ensuring that relative importances of the decision criteria are consistent with each other. For example, auctioneer agent may validate 410 the criteria comparison matrix by determining whether the condition $M_{ik}=M_{ij}\cdot M_{jk}$ is true for all elements i, j, k in the matrix. If the validation 410 is unsuccessful, auctioneer agent 225 reports 415 an error.

If the validation 410 is successful, auctioneer agent 225 proceeds to create 420 a criteria importance vector based on the criteria comparison matrix. In exemplary embodiments, the criteria importance vector is created 420 by computing the eigenvector of the criteria comparison matrix with the largest eigenvalue. The values of the elements of the vector are between 0 and 1, with the sum of values totaling 1.

Auctioneer agent 225 creates 425 a supplier comparison matrix corresponding to each decision criterion. The supplier comparison matrix represents a relative ranking of each supplier of the plurality of suppliers with respect to the decision criterion that corresponds to the supplier comparison matrix. In some embodiments, each supplier comparison matrix is validated 430 at least in part by ensuring that relative rankings of the suppliers are consistent with each other, such as described above with reference to validating 410 the criteria comparison matrix. If the validation 430 is unsuccessful, auctioneer agent 225 reports 415 an error. Otherwise, auctioneer agent 225 creates 435 a supplier criteria ranking vector corresponding to each decision criterion based on the supplier comparison matrix that corresponds to the decision criterion.

Auctioneer agent 225 combines 440 the supplier criteria ranking vectors and the criteria importance vector to create a supplier score matrix associated with ordering manager agent 215. The supplier score matrix indicates an AHP score associated with each supplier. In exemplary embodiments, auctioneer agent 225 combines 440 the supplier criteria ranking vectors and the criteria importance vector at least in part by combining the supplier criteria ranking vectors to create a supplier criteria ranking matrix, and multiplying the supplier criteria ranking matrix by the criteria importance vector to create the supplier score matrix.

In exemplary embodiments, at least a portion of method 400 is performed both to determine AHP scores associated with supplier agents 220 with respect to ordering manager agents 215 and to determine AHP scores associated with ordering manager agents 215 with respect to supplier agents 220. For example, auctioneer agent 225 may create an ordering manager score matrix associated with one or more suppliers, similar to combining 440 a supplier criteria ranking vectors and a criteria importance vector to create a supplier score matrix, as described above. The ordering manager score matrix indicates an AHP score associated with each ordering manager agent 215.

Auctioneer agent 225 selects 445 one or more supplier(s) based on the supplier score matrix. In exemplary embodiments, selecting 445 suppliers includes calculating a combined AHP score for each combination of an ordering manager agent i and a supplier j. For example, a combined AHP score k may be calculated by auctioneer agent 225 using Equation 1 below.

$$k=a\vee(k_{ij}+k_{ji}) \quad \text{(Eq. 1)}$$

In exemplary embodiments, $k_{ij}$ is the AHP score associated with supplier j with respect to manager i, and $k_{ji}$ is the AHP score associated with manager i with respect to supplier j. Auctioneer agent 225 may select 445 one or more suppliers by selecting the supplier(s) associated with the highest combined AHP score.

Auctioneer agent 225 calculates 450 a trade price associated with the requested part based at least in part on a bidding price from the ordering manager agent, an asking price from the selected supplier, and the AHP score associated with the selected supplier. The trade price associated with the requested part may be calculated 450 based further on the AHP scores associated with the ordering manager agents 215. In exemplary embodiments, the trade price is calculated 450 using Equation 2 below.

$$p_i=kb_i+(1-k)a_i \quad \text{(Eq. 2)}$$

In Equation 2, $b_i$ is the bidding price provided by an ordering manager agent i, and $a_j$ is the asking price by supplier j from manager i. k represents the combined AHP score described above with reference to Equation 1.

Auctioneer agent 225 proceeds to send 365 orders to the selected suppliers, including the calculated trade price, as described above with reference to FIG. 3. Accordingly, auctioneer agent 225 may be understood to order the requested part from one or more suppliers based on the supplier score matrix, which is, in turn, based on decision criteria associated with suppliers and the buyer.

Embodiments described herein facilitate automatically determining a price for a good, such an as equipment part, such that the good can be acquired from one or more suppliers based on decision criteria in addition to bidding and asking prices. Accordingly, such embodiments, enable purchasing decisions to take into account the imperfect substitutability of parts and/or sellers.

This written description uses examples to disclose various embodiments, which include the best mode, to enable any person skilled in the art to practice those embodiments, including making and using any devices or systems and performing any incorporated methods. The patentable scope is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A method for use in acquiring parts from one or more suppliers, said method comprising:

receiving, by an auctioneer agent executed by a computing system, auction information including a requested part and a plurality of decision criteria from an ordering manager agent of a plurality of ordering manager agents and from a plurality of supplier agents associated with a plurality of suppliers of the requested part;

creating, by the auctioneer agent, a criteria comparison matrix representing a relative importance of each decision criterion;

creating, by the auctioneer agent, a criteria importance vector based on the criteria comparison matrix;

creating, by the auctioneer agent, a supplier comparison matrix corresponding to each decision criterion, wherein the supplier comparison matrix represents a relative ranking of each supplier of the plurality of suppliers with respect to the corresponding decision criterion;

creating, by the auctioneer agent, a supplier criteria ranking vector corresponding to each decision criterion based on the supplier comparison matrix that corresponds to the decision criterion;

combining, by the auctioneer agent, the supplier criteria ranking vectors and the criteria importance vector to create a supplier score matrix associated with the ordering manager agent, the supplier score matrix indicating a score associated with each supplier, wherein the requested part is ordered from one or more suppliers based on the supplier score matrix;

selecting, by the auctioneer agent, a supplier based on the supplier score matrix;

creating, by the auctioneer agent, an ordering manager score matrix associated with the selected supplier, the ordering manager score matrix indicating a score associated with each ordering manager agent of the plurality of ordering manager agents; and calculating, by the auctioneer agent, a trade price associated with the requested part based at least in part on a bidding price from the ordering manager agent, an asking price from the selected supplier, and the score associated with the selected supplier, and the score associated with the ordering manager agent.

2. A method in accordance with claim 1, further comprising:

receiving, by the auctioneer agent from the ordering manager agent, an importance associated with each decision criterion; and creating, by the auctioneer agent, the criteria comparison matrix based at least in part on the importance associated with each decision criterion.

3. A method in accordance with claim 1, wherein combining the supplier criteria ranking vectors and the criteria importance vector comprises:

combining, by the auctioneer agent, the supplier criteria ranking vectors to create a supplier criteria ranking matrix; and multiplying, by the auctioneer agent, the supplier criteria ranking matrix by the criteria importance vector to create the supplier score matrix.

4. A method in accordance with claim 1, further comprising validating, by the auctioneer agent, the criteria comparison matrix at least in part by ensuring that relative importances of the decision criteria are consistent with each other.

5. A method in accordance with claim 1, further comprising validating, by the auctioneer agent, the supplier comparison matrix at least in part by ensuring that relative rankings of the suppliers are consistent with each other.

6. A method in accordance with claim 1, further comprising comparing, by the supplier agent, a desired quantity of a part to an available quantity of the part to determine that a shortage of the part exists, wherein the supplier agent transmits at least a portion of the auction information to the auctioneer agent based on the determined shortage.

7. A system for use in acquiring parts from one or more suppliers, said system comprising:

a storage device configured to store auction information including a requested part and a plurality of decision criteria from an ordering manager agent of a plurality of ordering manager agents and from a plurality of supplier agents associated with a plurality of suppliers of the requested part; and a processor unit coupled in communication with said storage device, wherein said processor unit is programmed to:

create a criteria comparison matrix representing a relative importance of each decision criterion;

create a criteria importance vector based on the criteria comparison matrix;

create a supplier comparison matrix corresponding to each decision criterion, wherein the supplier comparison matrix represents a relative ranking of each supplier of the plurality of suppliers with respect to the corresponding decision criterion;

create a supplier criteria ranking vector corresponding to each decision criterion based on the supplier comparison matrix that corresponds to the decision criterion;

combine the supplier criteria ranking vectors and the criteria importance vector to create a supplier score matrix associated with the ordering manager agent, the supplier score matrix indicating a score associated with each supplier, wherein the requested part is ordered from one or more suppliers based on the supplier score matrix;

select a supplier based on the supplier score matrix;

create an ordering manager score matrix associated with the selected supplier, the ordering manager score matrix indicating a score associated with each ordering manager agent of the plurality of ordering manager agents; and calculate a trade price associated with the requested part based at least in part on a bidding price from the ordering manager agent, an asking price from the selected supplier, and the score associated with the selected supplier, and the score associated with the ordering manager agent.

8. A system in accordance with claim 7, wherein said processor unit is further programmed to:

receive from the ordering manager agent an importance associated with each decision criterion; and create the criteria comparison matrix based at least in part on the importance associated with each decision criterion.

9. A system in accordance with claim 7, wherein said processor unit is programmed to combine the supplier criteria ranking vectors and the criteria importance vector at least in part by:

combining the supplier criteria ranking vectors to create a supplier criteria ranking matrix; and multiplying the supplier criteria ranking matrix by the criteria importance vector to create the supplier score matrix.

10. A system in accordance with claim 7, wherein said processor unit is further programmed to validate the criteria comparison matrix at least in part by ensuring that relative importances of the decision criteria are consistent with each other.

11. A system in accordance with claim 7, wherein said processor unit is further programmed to validate the supplier comparison matrix at least in part by ensuring that relative rankings of the suppliers are consistent with each other.

12. One or more non-transitory computer-readable media having computer-executable components embodied thereon, said computer-executable components comprising:

a supplier agent that when executed by at least one processor unit causes the processor unit to request an auction to an auctioneer agent based on a shortage of a requested part; and the auctioneer agent that when executed by at least one processor unit causes the processor unit to:

receive, based on the request for an auction, auction information including the requested part and a plurality of decision criteria from an ordering manager agent of a plurality of ordering manager agents and from a plurality of supplier agents associated with a plurality of suppliers of the requested part;

create a criteria importance vector based on a criteria comparison matrix representing a relative importance of each decision criterion;

create a supplier comparison matrix corresponding to each decision criterion, wherein the supplier comparison matrix represents a relative ranking of each supplier of the plurality of suppliers with respect to the corresponding decision criterion;

create a supplier criteria ranking vector corresponding to each decision criterion based on the supplier comparison matrix that corresponds to the decision criterion; combine the supplier criteria ranking vectors and the criteria importance vector to create a supplier score matrix associated with the ordering manager agent, the supplier score matrix indicating a score associated with each supplier, wherein the requested part is ordered from one or more suppliers based on the supplier score matrix;

select a supplier based on the supplier score matrix;

create an ordering manager score matrix associated with the selected supplier, the ordering manager score matrix indicating a score associated with each ordering manager agent of the plurality of ordering manager agents; and calculate a trade price associated with the requested part based at least in part on a bidding price from the ordering manager agent, an asking price from the selected supplier, and the score associated with the selected supplier, and the score associated with the ordering manager agent.

13. The one or more non-transitory computer-readable media in accordance with claim 12, wherein the auctioneer agent further causes the processor unit to:

receive from the ordering manager agent an importance associated with each decision criterion; and create the criteria comparison matrix based at least in part on the importance associated with each decision criterion.

14. The one or more non-transitory computer-readable media in accordance with claim 12, wherein the auctioneer agent further causes the processor unit to:

validate the criteria comparison matrix at least in part by ensuring that relative importances of the decision criteria are consistent with each other; and validate the supplier comparison matrix at least in part by ensuring that relative rankings of the suppliers are consistent with each other.

* * * * *